US005087160A

United States Patent [19]

Pezzutto

[11] Patent Number: 5,087,160

[45] Date of Patent: Feb. 11, 1992

[54] ANCHOR BOLT AND EXPANSION SHELL ASSEMBLY

[75] Inventor: Mario Pezzutto, Sudbury, Canada

[73] Assignee: American Mining Supply, Inc., North Ridgeville, Ohio

[21] Appl. No.: 180,376

[22] Filed: Apr. 12, 1988

[51] Int. Cl.[5] ..... F16B 31/00; F16B 13/06

[52] U.S. Cl. ..... 411/5; 411/42; 411/64; 405/259.1

[58] Field of Search ..... 411/2-5, 411/8, 9, 64-67, 72, 42, 47; 405/259-261

[56] References Cited

U.S. PATENT DOCUMENTS

| | | | |
|---|---|---|---|
| 2,787,931 | 4/1957 | McCabe . | |
| 2,870,666 | 1/1959 | Dempsey . | |
| 2,988,950 | 6/1961 | Dempsey . | |
| 3,115,056 | 12/1963 | Teeple, Jr. . | |
| 3,238,731 | 3/1966 | Seifert et al. . | |
| 3,250,170 | 5/1966 | Siegel . | |
| 3,306,051 | 2/1967 | Howlett . | |
| 3,522,755 | 8/1970 | Michell | 411/72 |
| 3,528,253 | 9/1970 | Kovacs . | |
| 3,683,741 | 8/1972 | Pete . | |
| 3,702,060 | 11/1972 | Cumming . | |
| 3,837,258 | 9/1974 | Williams . | |
| 3,967,455 | 7/1976 | Conway . | |
| 4,011,787 | 3/1977 | White et al. . | |
| 4,100,748 | 7/1978 | Hansen | 405/259 |
| 4,337,012 | 6/1982 | Sohnius | 411/3 |
| 4,516,883 | 5/1985 | Zeitler | 405/260 |

FOREIGN PATENT DOCUMENTS

| | | | |
|---|---|---|---|
| 515957 | 8/1955 | Canada . | |
| 590082 | 1/1960 | Canada . | |
| 618342 | 4/1961 | Canada . | |
| 618343 | 4/1961 | Canada . | |
| 748157 | 12/1966 | Canada . | |
| 756832 | 4/1967 | Canada . | |
| 782802 | 4/1968 | Canada . | |
| 786056 | 5/1968 | Canada . | |
| 936027 | 10/1973 | Canada . | |
| 937792 | 12/1973 | Canada . | |
| 946190 | 4/1974 | Canada . | |
| 1039986 | 10/1978 | Canada . | |
| 1153225 | 9/1983 | Canada . | |
| 2048419 | 12/1980 | United Kingdom | 411/67 |

*Primary Examiner*—Neill R. Wilson

[57] ABSTRACT

An expansion anchor assembly comprising a shell having three elongated vertical leaves of generally transverse arcuate configuration arranged to form a 360° surface, the exterior of each leaf being provided with a gripping surface, each leaf being attached at its top to a bail, the bail comprising a solid top portion having a frangible central dome through which a rock bolt can be forced, the interior diameter of the dome being adapted to receive the top end of the rock bolt, the top end of the rock bolt being chamfered to ensure that it remains secure within the central dome during installation and to prevent lateral movement of the rock bolt relative to the anchor shell, and a wedge-member being threadably engagable with the rock bolt and being adapted so that on longitudinal movement of the wedge-shaped member away from the ball, the leaves are wedged apart and relative rotation between the leaves and the wedge member is prevented.

16 Claims, 3 Drawing Sheets

ANCHOR BOLT AND EXPANSION SHELL ASSEMBLY

BACKGROUND OF THE INVENTION

This invention relates to an improved anchor bolt and expansion shell for use in underground and open pit mining, tunneling and surface excavation.

In using rock bolts for mine roof and wall support and for similar purposes, the rock strata is bored to a suitable depth as determined by the rock formation, it being desirable to bore to a depth sufficient to include in the strata a relatively thick layer of relatively hard rock. In boring, sections of the bore may deviate somewhat, variations in diameter and other irregularities occur, and on inserting an expansion anchor into the bore, there may be tendency for the anchor shell to shift laterally or become somewhat misaligned from the general access of the bore and the bolt. Such action may be due to deviations in the bore or soft spots or irregularities in the bore at the particular location where expansion of the anchor shell is contemplated. As the shell segments are expanded away from the bolt, the guiding effect of the bolt, to hold the segments in line with the bolt is gradually lost. Frequently, the shell segments will shift laterally or become askew and with the application of tension to the bolt, failure of the shell will result.

In the prior art there have been disclosed numerous expansion shell assemblies, examples of which can be seen in the following patents: Canadian Patent Nos. 515,957 issued August 23, 1955 to Joseph B. Dempsey; 590,082 issued Jan. 5, 1962 to The Ohio Brass Co., 618,342 issued Apr. 18, 1961 to Joseph B. Dempsey; 748,157 issued Dec. 13, 1966 to the Eastern Co.; 756,832 issued Apr. 18, 1967 to Rudolph Stutz; 782,802 issued Apr. 16, 1968 to Torque Tension Bolt Co. (Proprietary) Ltd.; 786,056 issued May 28, 1958 to Michell; 936,027 issued Oct. 30, 1973 to Richard H. Warner; 937,792 issued Dec. 4, 1973 to The Eastern Co.; 946,190 issued Apr. 30, 1974 to Huygmetaal N. V. and 1,153,225 issued Sept. 6, 1983 to Heinrich Sohnius; U.S. Pat. Nos. 2,988,950 issued Jan. 20, 1961 to J. b. Dempsey; 3,238,731 issued Mar. 8, 1966 to H. C. Seifert et al; 3,250,170 issued May 10, 1966 to N. H. Siegel; 3,306,051 issued Feb. 28, 1967 to G. H. Howlett; 3,528,253 issued Sept. 15, 1970 to L. J. Kovacs; 3,683,741 issued Aug. 15, 1972 to George H. Peat; 3,702,060 issued Nov. 7, 1972 to James Dean Cumming; 3,837,258 issued Sept. 24, 1974 to Chester I. Williams; 3,967,455 issued July 6, 1976 to John P. Conway; and 4,011,787 issued Mar. 15, 1977 to Lewis P. White et al.

Because of their length, lengths of up to 40 feet not being uncommon rock bolts are extremely heavy and a falling bolt can be not only dangerous for the worker, but also damaging to expensive mining or excavation equipment. It is thus absolutely necessary that an expansion anchor be as failsafe as possible, i.e. as sure and reliable as possible, and further, be capable of being quickly set in place. Generally a power tool is used to apply tension to the rock bolt. Thus, the forces acting upon the expansion anchor are tremendous. In the event the rock bolt assembly is not properly positioned within the bore hole, the forces are definitely sufficient to readily damage the anchor shell and render it inoperative. Aside form safety aspects and possible injury and damage to workers and equipment, respectively, there is also the problem that the end of the rock bolt and the expansion anchor must remain properly aligned once positioned within the bore hole and during entry so that the anchor will expand in the required way to ensure that the assembly is secured in place. With the bolts previously described, it seems that the failure rate because each bolt does not remain aligned with the expansion anchor can be as high as 15 percent. Thus, there is the additional problem of the expense of damage or wasted anchors.

In the expansion anchors, described previously, attempts have been made to ensure that the end of the rock bolt remains aligned with the top of the bail so that when tension is applied to the lower end of the bolt the bail is not broken. For example in Canadian Patent No. 618,342, there is described an expansion anchor shell having a U-shaped bail with an enlarged bight portion in which there is provided a circular aperture sized to receive the end of a rock bolt. The problem with this shell is that frequently during installation, dirt may the threads of the rock bolt and hence damage to the assembly can be caused, making it inoperative. In Canadian Patent No. 618,343 there is shown a flat knockout plug in the circular aperture of the enlarged bight. However, the flat surface does not ensure that the end of the rock bolt remains correctly aligned with the aperture and cocking of the U-shaped bail can readily occur. This can result in damage to the bail when tension is applied to the rock bolt via a power tool and consequently it becomes inoperative.

In Canadian Patent No. 1,153,225 there is described an anchor bolt expansion shell wherein the bail includes a cap member which incorporates a central dimple portion extending halfway in a direction towards the leaves with a peripheral line of weakness formed about the dimple portion. The difficulty with this structure is that the end of the bolt is frequently fouled and contact with the downwardly directed dimple portion is not so certain and hence expansion shell failure is substantially high than desirable and certainly within the 15 percent figure previously mentioned.

BRIEF SUMMARY OF THE INVENTION

The present invention provides an expansion anchor assembly comprising a shell having a plurality of elongated vertical leaves of generally transverse arcuate configuration arranged to form a 360° surface, the exterior of each leaf being provided with as gripping surface, each leaf being joined at its top to a bail, the bail comprising a solid top portion having a frangible central dome through which a rock bolt can be forced, the dome being shaped to receive the top end of the rock bolt, which in turn is chambered to ensure that it remains within the central dome during installation and to prevent lateral movement of the rock bolt relative to the anchor shell, and a wedge member being threadably engagable with the rock bolt and being adapted so that on longitudinal movement of the wedge shaped member away from the bail, the leaves are wedged apart and relative rotation between the leaves and the wedge member is prevented.

The shell preferably comprises three leaves while the bail includes three legs attached to a solid, circular yoke in which the dome is centrally located, one leaf being joined to one leg of the bail. The three leaves each form a segment of a hollow cylinder and are arranged to form a 360 degree gripping surface for the shell.

The gripping surface on each leaf preferably comprises a plurality of circumferential serrations which when the shell is to be secured in hard rock have generally downwardly directed sharp edges, but when the shell is to be secured in soft rock have generally downwardly directed rounded edges.

Each leaf is joined to the leg of the bail by any conventional means, but more preferred is riveting. The legs of the bail, yoke and dome are preferably formed by cold pressing eighteen gauge cold rolled steel. The dome portion when pressed out includes raised, flat, yoke portion, the outer edges of which define the frangible area of the top of the bail. The bail, yoke and dome are formed in a three stage cold pressing. In the first stage, the dome is formed and holes are punching in the steel for the rivets. In the second stage, the edge of the dome is perforated with the raised yoke portion defining the perforation. Continuous connection remains between the raised yoke and the bail at a spot adjacent each of the legs in the finished piece. The legs of the bail are cut out and the round top of the bail are formed in the final or third stage. After this pressing, the bail is attached to the leaves with rivets.

As mentioned earlier, the end of each rock bolt is chamfered or beveled to ensure that it fits into and remains within the domed portion of the cap member or bail. The end of the bolt is preferably chamfered or beveled so that its diameter is about ⅜ and the depth of the chamfering is preferably about the same dimension. Generally, the rock bolt may be ⅝ or ¾ in diameter.

Thus, in its most preferred form, the invention comprises a rock bolt assembly comprising a shell having three elongated vertical leaves of generally transverse arcuate configuration arranged to form a 360 degree gripping surface, the exterior of each leaf having a plurality of either sharp or rounded downwardly directed serrations, each leaf being secured at its top to a bail by means of a rivet, the bail comprising a solid top portion having a frangible central dome, which includes a flat yoke portion, the outer edge of which defines the frangible area of the top of the bail and through which a rock bolt can be forced, the interior diameter of the dome being substantially equal to the diameter of the end of the rock bolt, the rock bolt having been chamfered to ensure that it remains secure within the central dome during installation and to prevent lateral movement of the rock bolt relative to the anchor shell, and a wedge member being threadably engagable with the rock bolt and being further adapted so that on longitudinal movement of the wedge-shaped member away from the bail, the leaves are wedged apart and relative rotation between the leaves and the wedge member is prevented.

When the expansion anchor shell is placed on the end of the bolt, the end of the bolt rests inside the dome, not only because of the interior diameter of the domed portion of the bail but also because the chambering at the end of the bolt permits it to do so. The bolt is generally prevented from moving laterally, not only as the assembly is pushed into the bore hole, but also when tension is applied to the bolt. In addition the dome and solid yoke cover the end of the rock bolt and the top of the wedge member so that the two are not fouled during installation.

The rock bolt or roof bolt used in the assembly of the present invention is preferably one hundred percent forged steel which permits it to be reused.

BRIEF DESCRIPTION OF THE DRAWINGS

In the accompanying drawings used to illustrate the present invention.

DETAILED DESCRIPTION

Figure 5:
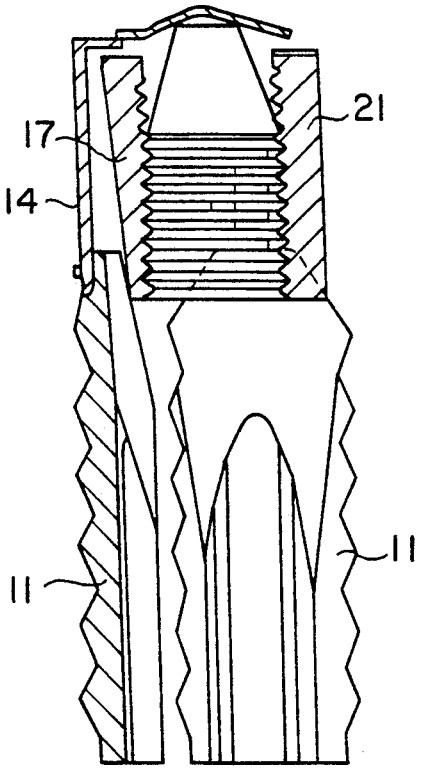
FIG. 5 is a partial cut-away view of the assembly.
Figure 6:
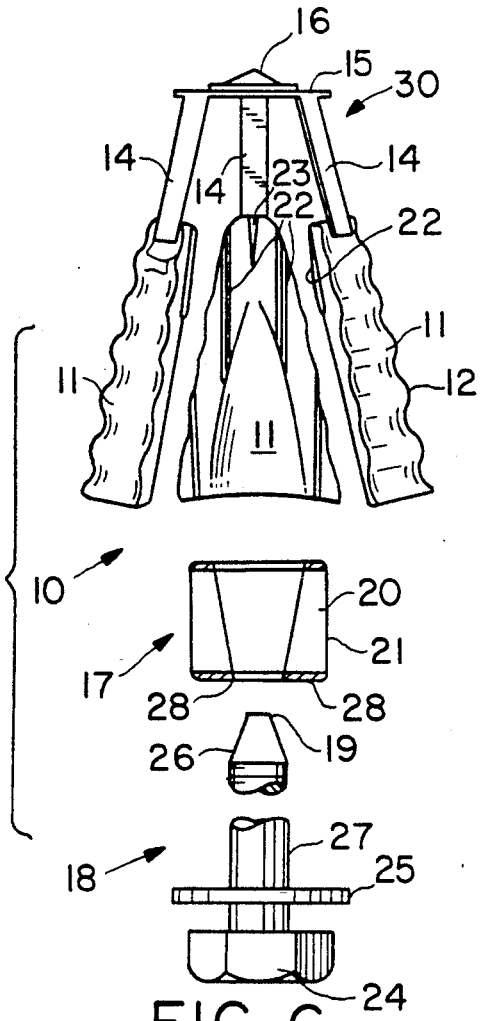
FIG. 6 is an exploded view of the rock bolt assembly.
Figure 7:
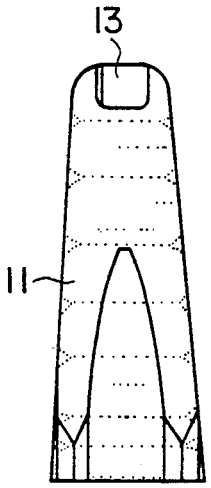
FIG. 7 is a front view of a leaf for use in soft rock.
Figure 8:
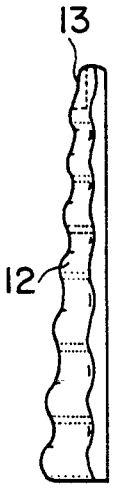
FIG. 8 is a profile view of the leaf of FIG. 7.
Figure 12:
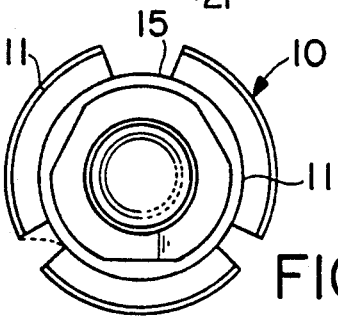
FIG. 12 is a bottom plan view of a shell.

Referring first to FIG. 6 of the drawings there is illustrated a rock bolt assembly which comprises an expansion anchor shell designed generally at 10, which includes a wedge member designated generally at 17 and a rock bolt designed generally at 18. Referring now also to FIG. 12, the expansion anchor shell 10 comprises, in this instance, three elongated vertical leaves of generally transverse arcuate configuration attached to a bail designated generally at 30. Each leaf takes the form of a segment of a hollow cylinder, the outer diameter of which is substantially equal to the outer diameter of the bail 30 or the wedge member 17. The leaves 11 are also wedge-shaped with the top of each leaf being smaller than the bottom. The interior diameter of the hollow cylinder formed by the leaves is such that the leaves loosely surround the roof bolt 18. The exterior of each leaf is provided with a plurality of circumferential serrations 12, which referring to FIGS. 5 to 8, may have downwardly directed rounded edges (see FIGS. 5 and 6) for engaging the sides of bore holes made in soft strata or the edges can be sharp (as seen in FIGS. 7 and 8) for engaging the sides of bore holes made in hard strata.

At the upper end of each leaf 11 there is provided a depression 13 which is sized to receive an end of a leg 14 of the bail 30. The leg 14 is preferably riveted to the leaf 11. The legs 14 of bail 30 are integrally formed with a circular, flat yoke 15, a circular top portion of which is cold pressed to form a dome 16 and raised yoke portion **16*a*, the outer diameter of which defines the frangible portion of the top of the bail. The outer diameter of the raised yoke portion is such that the rock bolt may pass through the top of the bail once the dome has been broken. The diameter of the dome 16 is chosen so that it corresponds with the diameter of the rock bolt 18, the end of which is chamfered and the chamfering depth is such that the upper end 19 of the rock bolt 18 can rest inside the dome 16 during installation of the assembly. The chamfering at the end of the rock bolt 18 ensures that it is further secured within the dome 16**.

Figure 4:
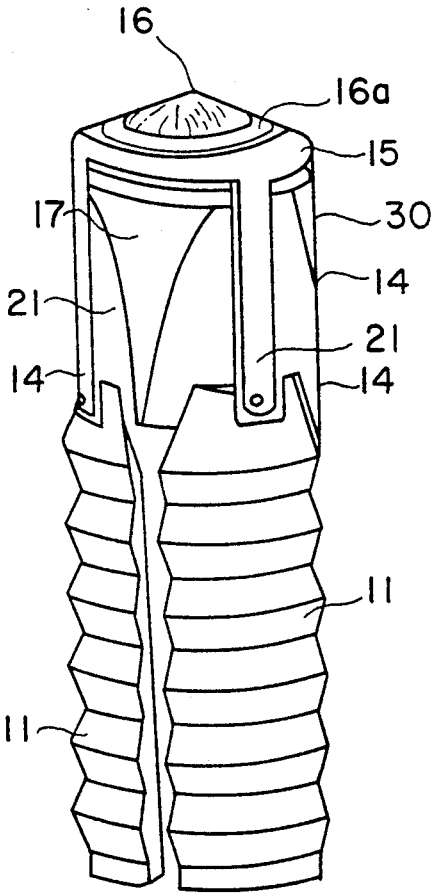
FIG. 4 is a side view of an anchor shell and belt.
Figure 9:
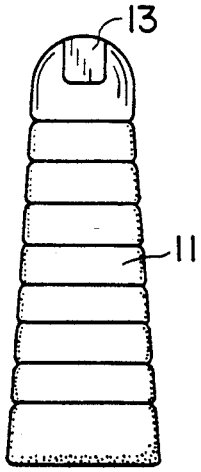
FIG. 9 is a front view of a leaf for use in hard rock.
Figure 10:
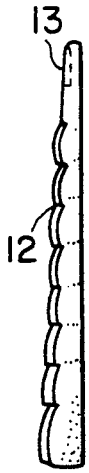
FIG. 10 is a profile view of the leaf of FIG. 9.
Figure 11:
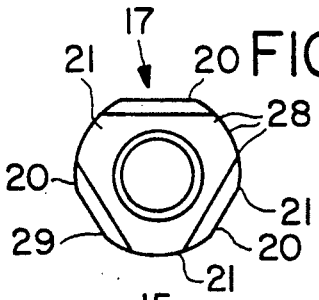
FIG. 11 is a bottom plan view of a wedge member.

Referring now to FIGS. 4 and 9, wedge member 17 is generally shaped like a cylindrical, hollow nut, and is provided with three wedge-shaped portions 20 on its exterior surface. The width of each wedge-shaped portion is greater at its top than at its bottom. Two different shapes of wedge-shaped portions are shown in the drawings. Certainly, the shape of these portions can vary as long as they can perform their required function. The areas intermediate the wedge shaped portions form slots 21 over which leaves 11 can slide. The interior surface of each leaf 11 is provided with a pair of projections 22 which extend perpendicularly from the top of the leaf and down along the sides for about two-thirds the length of the leaf and a single projection 23 which extends perpendicularly from the top of the leaf and down along the central axis of the leaf for about one-eighth the length of the leaf. The slots 21 on the surface of the wedge-shaped member contain grooves 28 which mate with the projections and ensure alignment of the leaves 11 with the slots 21 and hence smooth expansion of the leaves 11.

The interior of the wedge member 17 is provided with a threaded axial bore 29 which is adapted to receive the rock bolt 18. The rock bolt 18 has a plain, smooth shank 27, a head 24 on its lower end, and a length of thread 26 starting at its top end 19 and a chamfered or beveled end portion 19*a*, the thread 26 engaging the threaded axial bore of wedge member 17. The length of thread 26 is limited to permit only that amount of travel of the bolt 18 through the wedge member 17 which will result in maximum expansion of the anchor shell leaves 11 and which will not result in the wedge member 17 being pulled completely through the shell.

Figure 1:
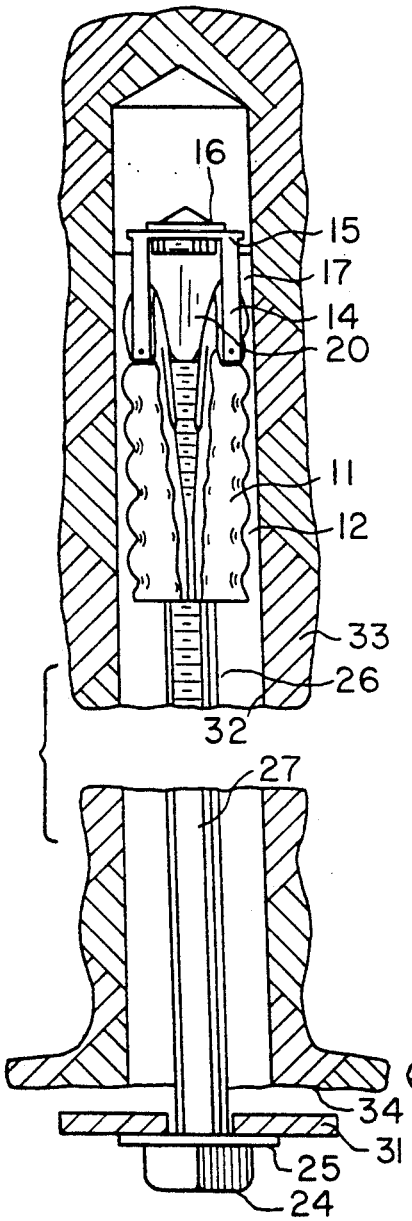
FIG. 1 shows a rock bolt assembly, incorporating an expansion anchor, located in a bore hole (shown in cross section) prior to the application of tension to a rock bolt.
Figure 2:
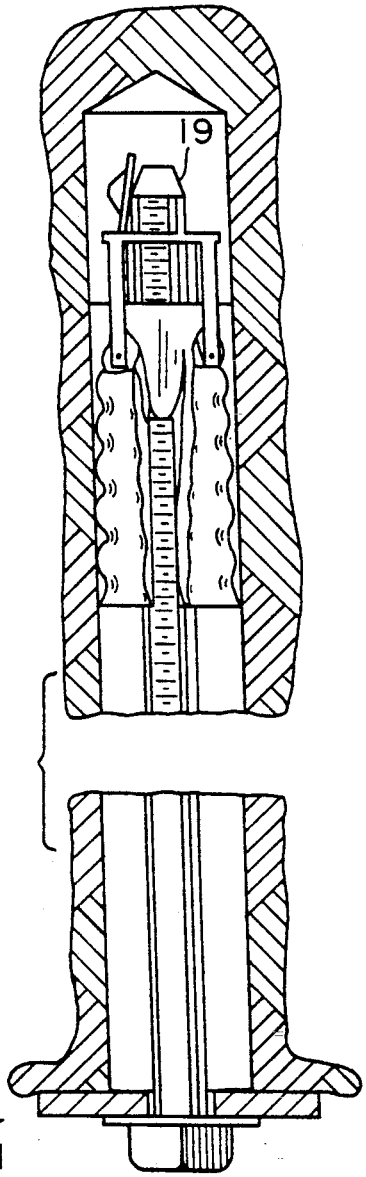
FIG. 2 shows the rock assembly of FIG. 1 after tension has been applied to the rock bolt.
Figure 3:
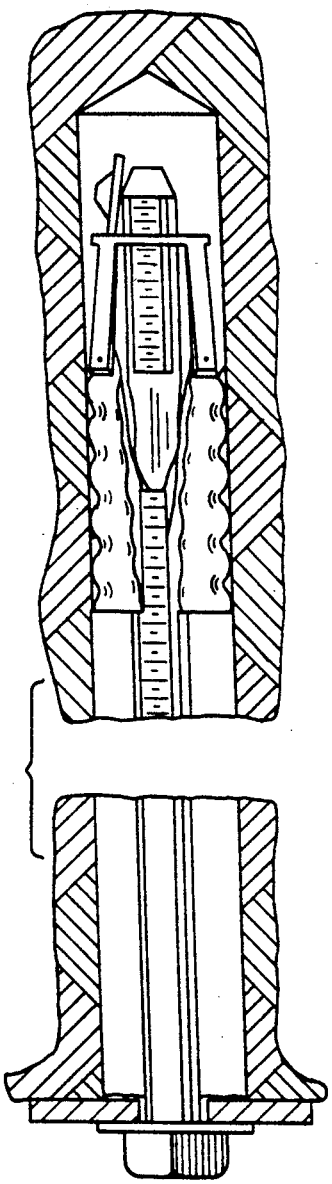
FIG. 3 shows the rock bolt assembly of FIG. 1 when it has been fully tightened.

Referring now to FIGS. 1 to 3, assembly and installation of the rock bolt assembly will be described. The rock bolt assembly includes a flange 31 and a washer 25, the washer 25 being slipped first over the upper end of the rock bolt 18, followed by the flange 31. The wedge-member 17 having the anchor shell pre-assembled thereon is then threaded over the top end of the rock bolt 18 until the end 19 of the bolt 18 rests inside the dome 16. At this point the leaves 11 will have sprung slightly apart at their lower ends so that when the assembly is pushed upwardly into the bore hole 32, as shown in FIG. 1, the lower edges of the serrations 12 and the ends of the leaves 11 drag against the wall of the bore hole to temporarily retain the assembly therein.

The assembly is inserted into the hole 32 until the flange 31 almost touches rock face 34. The head 24 of the bolt 18 is freed for engagement with a power tool (not shown) however, the assembly because of its weight will usually drop down slightly before the lower ends of leaves 11 and serrations 12 start to grip the wall of the bore hole 32, particularly if the bore hole 32 is somewhat larger than the exterior diameter of the assembly. Dome 16 plays a role at this time also since it permits the end 19 and chamfered portion 19*a* of the bolt 18 to be readily located within the dome 16 should any cocking of the expansion anchor shell occur. The end 19 of the bolt 18 is chamfered (at 19*a*) and this readily assists its location within the dome 16. At the same time dome 16 covers the top of the bolt 18 and wedge member 17, preventing any fouling of their respective threads. Once tension has been applied which for the present assembly generally ranges from 12 to 14 p.s.i. to pop out the dome, the head 24 of the bolt 18 will tighten the washer 25 and the flange 31 against rock face 34. As the bolt 18 is rotated, the initial movement will cause bolt 18 to rise until it contacts the top of and knocks out dome 16 by breaking the outer edge of the raised yoke portion 16*a*. Continued rotation moves wedge member 17 axially down and away from the bail. The corresponding or mating projections 22, 23 on the inside surfaces of leaves 11 and grooves 28 in the slots 21 of the wedge member 17 act as guides and ensure that this movement is smooth. The downward axial movement results from serrations 12 of leaves 11 digging into the wall of bore hole 32 and the wedge portions 29 between the side edges of leaves 11 prevent relative rotation between the wedge-member 17 and leaves 11. As the wedge-member 17 moves downwardly, the wedge shapes of portions 20 and leaves 11 result in further expansion of leaves 11 and hence more secure engagement of the assembly within the bore hole 32.

It should be noted that in prior art assemblies the tension required to force an anchor bolt through the cap or bail top generally is about 18 p.s.i. This is true regardless of whether the top of the bail is dimpled inwardly or flat. In use flat top bails tend to fail because the rock bolt tends to tear the whole bail top off during installation.

I claim:

1. In a rock bolt assembly comprising an anchor shell having expansion leaves for gripping the sides of a bore hole, a ball having a bight portion and respective legs connected to said bight portion and the top of the said leaves, a rock bolt disposed within said leaves essentially coaxially therewith, said bolt having an internally threaded wedged shaped expansion member on said bolt for expanding said leaves, the bight portion of said bail having a break out frangible portion centered about the axis of the bolt which is to be tensioned and broken out by the end of said roof bolt on expansion of said leaves to provide an opening for the passage of the roof bolt, the improvement comprising a central dome on said frangible portion rising from adjacent the periphery of the frangible portion to above the bight from a bottom opening in the underside of the frangible portion for effecting a centering of a bolt misaligned in the shell, said dome having interior wall means converging upwardly from essentially all sides of the bottom opening toward the axis of the bolt to provide a dome housing which progressively reduces in cross section for receiving the end of the bolt and for guiding the bolt inwardly into the housing toward the center of the dome and constraining the end of the bolt to engagement with a central location inwardly of the bottom of the housing along the dome axis.

2. A rock bolt assembly as defined in claim 1 in which said end of the bolt has a diameter substantially reduced as compared to the diameter of the bolt.

3. A rock bolt assembly as defined in claim 2 in which said rock bolt has a chamfered portion extending axially of the bolt from the threads of the bolt to provide said reduced diameter bolt end and to space the threads of the bolt from the bight.

4. A rock bolt assembly as defined in claim 1 wherein said wall means is substantially conical in configuration.

5. A mine roof assembly as defined in claim 2 wherein said wall means is substantially conical in configuration.

6. A mine roof assembly as defined in claim 3 wherein said wall means is substantially conical in configuration.

7. A rock bolt assembly as defined in claim 1 wherein the bolt has a chamfered portion extending axially from the end of the bolt and outside of said housing, said chamfered portion having a conically tapered periphery to provide the bolt end of substantially reduced diameter from the diameter of the bolt.

8. A rock bolt assembly as defined in claim 7 wherein said wall means is substantially conical in configuration.

9. A rock bolt assembly as defined in claim 1 wherein the legs of the bail extend over and along the exterior of the outer periphery of the wedge nut.

10. A rock bolt assembly as defined in claim 1 in which said bight is flat and said dome has a flat annular portion between the dome and the outer periphery of the frangible portion.

11. A rock bolt assembly as defined in claim 2 in which said bight is flat and said dome has a flat annular portion between the dome and the outer periphery of the frangible portion.

12. A rock bolt assembly as defined in claim 8 in which said bight is flat and said dome has a flat annular portion between the dome and the outer periphery of the frangible portion.

13. A rock bolt assembly as defined in claim 10 wherein said dome is circular.

14. A rock bolt assembly as defined in claim 8 wherein said bight is flat and circular and comprises an annular first metal portion connected at its outer periphery to said legs and said break out portion, said break out portion being a circular portion severed from said metal portion and having a second flat annular portion with spaced unsevered break away portions at its outer periphery connecting said frangible portion to said first metal portion and said dome being a circular dome which rises from the inner periphery of said second annular portion.

15. A bail for connecting expansion leaves of a rock bolt assembly, the bail having including break out structure in the center of the bight for engagement by a rock bolt and for breaking away under tension to provide an opening for the passage of the bolt, said bail being formed from a single metal sheet and comprising a flat bight having a plurality of spaced legs extending substantially perpendicularly from the underside of said bight at the outer periphery of an outer peripheral bight portion for connection to the expansion leaves of a rock bolt assembly, said break out structure being severed from said bight at the interior periphery of said peripheral bight portion and having unsevered break away portions on its outer periphery connecting said break out structure to said bight portion and said break out structure further comprising an outside peripheral portion having said unsevered portions at its outer periphery and a dome centered on said centerline rising from the inner periphery of said outside portion and having a bottom opening which opens into said underside of the bight for receiving a rock bolt end, said dome having internal walls converging upwardly from said bottom opening from all sides thereof for constraining the rock bolt to move toward the centerline and for constraining it from moving away from a central location along said centerline.

16. A bail as defined in claim 15 in which said outside peripheral portion of the break out structure is an annular circular structure and said dome is a circular dome having a conically shaped internal wall.

* * * * *